US007125223B2

(12) United States Patent
Turnquist et al.

(10) Patent No.: US 7,125,223 B2
(45) Date of Patent: Oct. 24, 2006

(54) METHOD AND APPARATUS FOR TURBOMACHINE ACTIVE CLEARANCE CONTROL

(75) Inventors: Norman Arnold Turnquist, Sloansville, NY (US); Hamid Reza Sarshar, The Woodlands, TX (US); Biao Fang, Clifton Park, NY (US); Mehmet Demiroglu, Troy, NY (US); Bernard Arthur Couture, Schenectady, NY (US); Clement Gazzillo, Schenectady, NY (US); Edip Sevincer, Troy, NY (US)

(73) Assignee: General Electric Company, Niskayuna, NY (US)

( * ) Notice: Subject to any disclaimer, the term of this patent is extended or adjusted under 35 U.S.C. 154(b) by 258 days.

(21) Appl. No.: 10/675,364

(22) Filed: Sep. 30, 2003

(65) Prior Publication Data

US 2005/0069406 A1 Mar. 31, 2005

(51) Int. Cl.
*F01D 11/22* (2006.01)
*F01D 11/16* (2006.01)

(52) U.S. Cl. ..... 415/173.2; 415/14; 415/173.1; 415/174.1; 277/413; 277/416

(58) Field of Classification Search ..... 415/14, 415/126, 128, 136, 138, 139, 173.1, 173.2, 415/173.3, 174.1, 174.2, 12; 277/409, 412, 277/413, 416
See application file for complete search history.

(56) References Cited

U.S. PATENT DOCUMENTS 907,981 A * 12/1908 Ferranti ..... 415/173.6
2,279,863 A * 4/1942 Downer ..... 277/413
2,614,870 A * 10/1952 Ray ..... 277/413
3,146,992 A * 9/1964 Farrell ..... 415/12
4,714,404 A * 12/1987 Lardellier ..... 415/173.2
5,104,287 A * 4/1992 Ciokajlo ..... 415/173.2
5,203,673 A 4/1993 Evans
5,545,007 A * 8/1996 Martin ..... 415/173.2
5,601,402 A 2/1997 Wakeman et al.
5,810,365 A * 9/1998 Brandon et al. ..... 277/416
5,971,400 A * 10/1999 Turnquist et al. ..... 277/416
6,572,114 B1 * 6/2003 Magoshi et al. ..... 277/416
6,584,434 B1 6/2003 Schick et al.
6,594,555 B1 7/2003 Steingraeber
6,655,696 B1 * 12/2003 Fang et al. ..... 277/409
6,786,487 B1 * 9/2004 Dinc et al. ..... 277/413
2004/0100035 A1 * 5/2004 Turnquist et al. ..... 277/412

* cited by examiner

*Primary Examiner*—Christopher Verdier
(74) *Attorney, Agent, or Firm*—Richard A. DeCristofaro; Patrick K. Patnode

(57) ABSTRACT

An apparatus for providing active clearance control between blade tips and seals in a turbomachine comprising: a first stator carrier segment, with stator seals centripetally disposed on it; a second stator carrier segment located along a same circumference as the first stator carrier segment, also with stator seals centripetally disposed on it; a shell that adjustably houses the first stator carrier segment and the second carrier segment; at least one displacement apparatus in operable communication with at least one stator carrier segment and configured to position the at least one stator carrier segment to provide active clearance control to the stator seals disposed on the at least one stator carrier segment.

3 Claims, 10 Drawing Sheets

METHOD AND APPARATUS FOR TURBOMACHINE ACTIVE CLEARANCE CONTROL

TECHNICAL FIELD

The current disclosed method and apparatus relate to turbomachines such as steam and gas turbines. More specifically, the disclosed method and apparatus relate to controlling the clearance between the tips of the blades and seals of such turbomachines.

BACKGROUND OF THE INVENTION

Turbomachines generally have a centrally disposed rotor that rotates within a stationary cylinder or shell. The working fluid flows through one or more rows of circumferentially arranged rotating blades that extend radially from the periphery of the rotor shaft and one or more rows of circumferentially arranged stator blades that extend centripetally from the interior surface of the shell to the rotor shaft. The fluid imparts energy to the shaft that is used to drive a load, such as an electric generator or compressor. In order to ensure that as much energy as possible is extracted from the fluid, the tips of the stator blades are usually very close to the seals located on the rotor surface, and the tips of the rotating blades are usually very close to the seals located on the internal surface of the shell. From the standpoint of thermodynamic efficiency, it is desirable that the clearance between the stator blade tips and the seals on the rotor surface, and between the rotating blade tips and the seals on the shell be maintained at a minimum so as to prevent excessive amounts of fluid from bypassing the row of rotating blades and stator blades.

Unfortunately, differential thermal expansion during operating conditions between the shell and the rotor results in variations in the tip clearances. In addition various operating conditions affect tip clearances—for example, tip clearances in gas turbine compressors often reach their minimum values during shutdown, whereas the tip clearances in low pressure steam turbines often reach their minimum values at steady state full load operation. Consequently, if insufficient tip clearance is provided at assembly, impact between the stator blade tips and rotor seals and impact between the seals on the shell and the rotating blade tips may occur when certain operating conditions are reached. These impacts are commonly known as "rubs." Also turbomachines are subjected to a variety of forces under various operating conditions, particularly during transient conditions, such as start-ups, shutdowns, and load changes. These forces may also cause rubs. Rubs often cause severe damage to the blades and seals of the turbomachine. However, in turbomachines with drum rotor type construction, space is limited and a large number of seals prevent the movement of individual seals to control the seal clearances. Accordingly, a method and apparatus for actively controlling the clearances in a turbomashine with a drum rotor type construction in order to prevent rubs is desired.

BRIEF DESCRIPTION OF THE INVENTION

Embodiments of the disclosed apparatus relate to an apparatus for providing active clearance control between blade tips and seals in a turbomachine comprising: a first stator carrier segment, with stator seals centripetally disposed on it; a second stator carrier segment located along a same circumference as the first stator carrier segment, also with stator seals centripetally disposed on it; a shell that adjustably houses the first stator carrier segment and the second carrier segment; at least one displacement apparatus in operable communication with at least one stator carrier segment, of the first and second carrier segments, and configured to position the at least one stator carrier segment to provide active clearance control to the stator seals located on the at least one stator carrier segment.

Other embodiments of the disclosed apparatus relate to a turbomachine with active clearance control. The turbomachine comprises: a centrally disposed rotor; at least one row of rotating blades extending radially from the rotor, and each of the rotating blades having a rotor blade tip; a shell enclosing the rotor and rotating blades; at least one stator carrier split along a splitline into a first segment and a second segment, with at least one row of stator blades extending centripetally from the first segment and from the second segment, the at least one stator blade carrier adjustably housed within the shell and each of the stator blades having a stator blade tip, and with stator seals centripetally disposed on the first segment and second segment; and at least one displacement apparatus in operable communication with the first segment and the second segment, and the at least one displacement apparatus is configured to move the first segment and second segment radially away from each other thereby providing active clearance control to the rotor blade tips and the stator blade tips.

In addition, other embodiments of the disclosed apparatus relate to a control system for providing active clearance control to a turbomachine comprising: a stator carrier split along a splitline into a first segment and a second segment, with at least one row of stator blades extending centripetally from the first segment and from the second segment, and stator seals centripetally disposed on the stator carrier; a shell that adjustably houses the stator carrier and stator blades; and at least one displacement apparatus in operable communication with the first segment and the second segment, and the at least one displacement apparatus is configured to move the first segment and second segment radially away from each other.

Also, other embodiments of the disclosed method relate to a method of active clearance control for a turbomachine. The method comprises: determining when a possible rub generating condition will occur; radially separating a stator carrier first segment and a stator carrier second segment prior to the possible rub generating condition; and restoring the stator carrier first segment and stator carrier second segment to their original positions after the possible rub generating condition has occurred.

BRIEF DESCRIPTION OF THE DRAWINGS

Referring now to the figures, which are exemplary embodiments, and wherein like elements are numbered alike.

DETAILED DESCRIPTION OF THE INVENTION

A detailed description of several embodiments of the disclosed apparatus and method are presented herein by way of exemplification and not limitation with reference to FIGS. 1 through 10.

Steam Turbine

Figure 1:
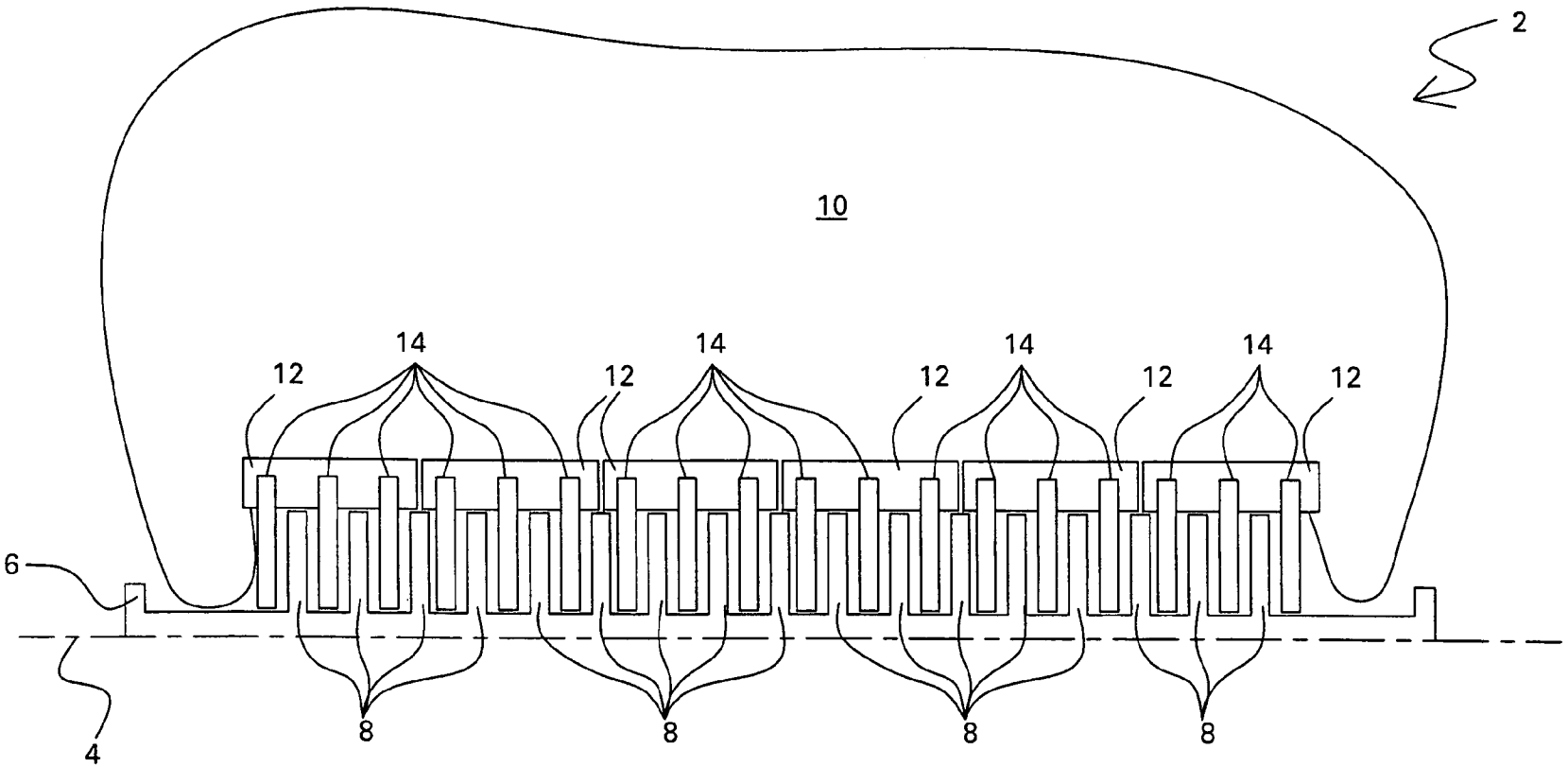
FIG. 1 depicts a top half-view of a steam turbine with the top casing removed.
Figure 2:
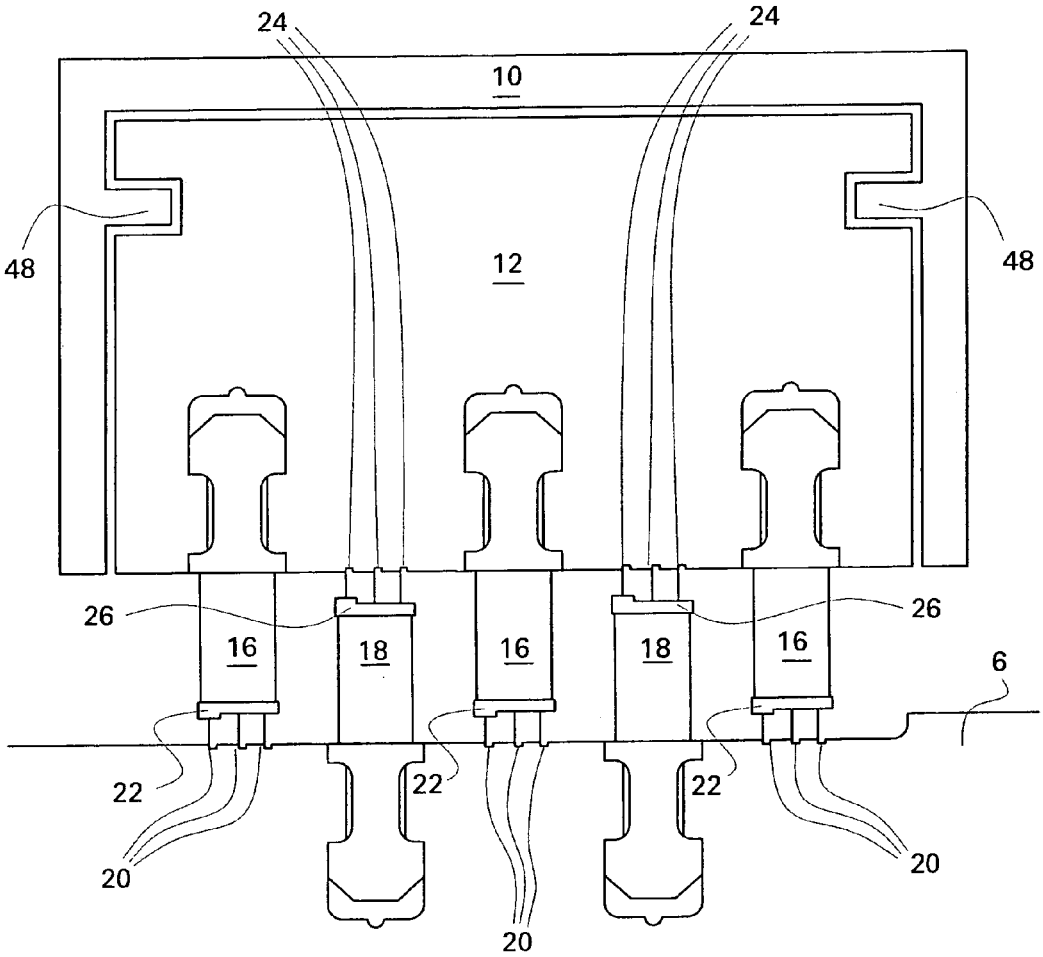
FIG. 2 depicts a close-up view of one stator carrier housed within an shell.

FIG. 1 depicts one embodiment of the disclosed apparatus and shows a top view of one half of a steam turbine 2 with a top of half of its shell removed at its horizontal splitline, which is a horizontal plane coincident with the horizontal centerline 4. A drum rotor 6 is shown centrally disposed along the horizontal centerline 4. Although embodiments of the apparatus are shown with respect to drum rotor type turbomachines, the teachings herein may also be applied to turbomachines with non-drum rotors. Extending radially from the rotor 6 are a plurality of rows of rotating blades 8. FIG. 2 will provide a more detailed view of the rotating blades. Other embodiments of the disclosed apparatus may have only a single row of rotating blades, or up to substantially more rows than shown in FIG. 1. Enclosing the rotor 6 and rows of rotating blades 8 is a shell 10. Adjustably housed within the shell 10 are several stator carriers 12. Extending centripetally from the stator carriers 12 are a plurality of rows of stator blades 14. FIG. 2 will show the stator blades more clearly. Other embodiments of the disclosed apparatus may have only a single stator carrier, with only a single row of stators extending therefrom, up to substantially more stator carriers with one or more rows of stator blades than shown in FIG. 2. In addition, although a steam turbine is shown in FIG. 1, other embodiments of the disclosed apparatus may be configured for any other turbomachines.

Stator Carrier

FIG. 2 shows a close-up view of one stator carrier 12 housed within the shell 10. Three stator blades 16 are shown extending centripetally from the stator carrier 12, the three blades correspond to three rows of stator blades. Shown extending radially from the rotor 6 are two rotating blades 18. Extending from the rotor 6 are rotor seals 20 which form seals between the stator blade tips 22 and the rotor 6. Extending from the stator carrier 12 are stator carrier seals 24, which form seals between the rotor blade tips 26 and the stator carrier 12.

During steam turbine transients, including but not limited to startups, shutdowns and load changes, the rotor 6 may move radially relative to the shell 10, causing the seals 24 and 20 to rub against their corresponding sealing surfaces, the rotating blades 18 and the stator blades 16, respectively. Rubs often lead to the clearances between the seals and the sealing surfaces to open, which is problematic. The open clearances can lead to seal leaks, inefficiency of the steam turbines, and performance degradation.

Therefore, an embodiment of the disclosed apparatus uses displacement apparatuses to move circumferential segments of the stator carriers radially away from each other, thereby providing an active clearance control between the seals and the sealing surfaces. The displacement apparatuses may be a springs, bellows, inflatable tubes, rods, cams, hydraulic cylinders, piezoelectric devices, wires, cables, bi-metallic materials, phase changing materials, solenoids, pneumatic bellows actuators or combinations thereof.

Figure 7:
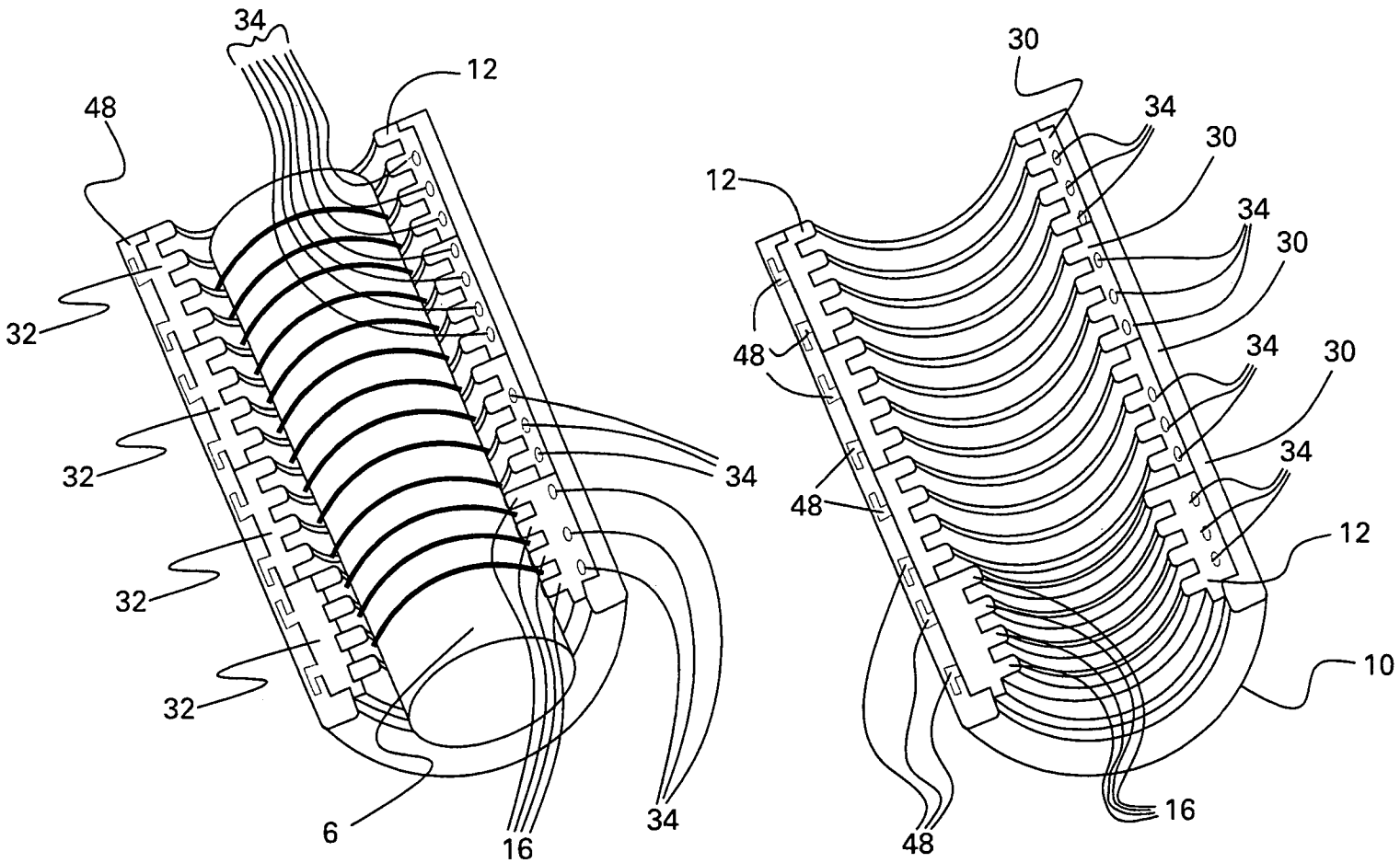
FIG. 7 depicts a perspective view of a portion of a shell assembly.
Figure 8:
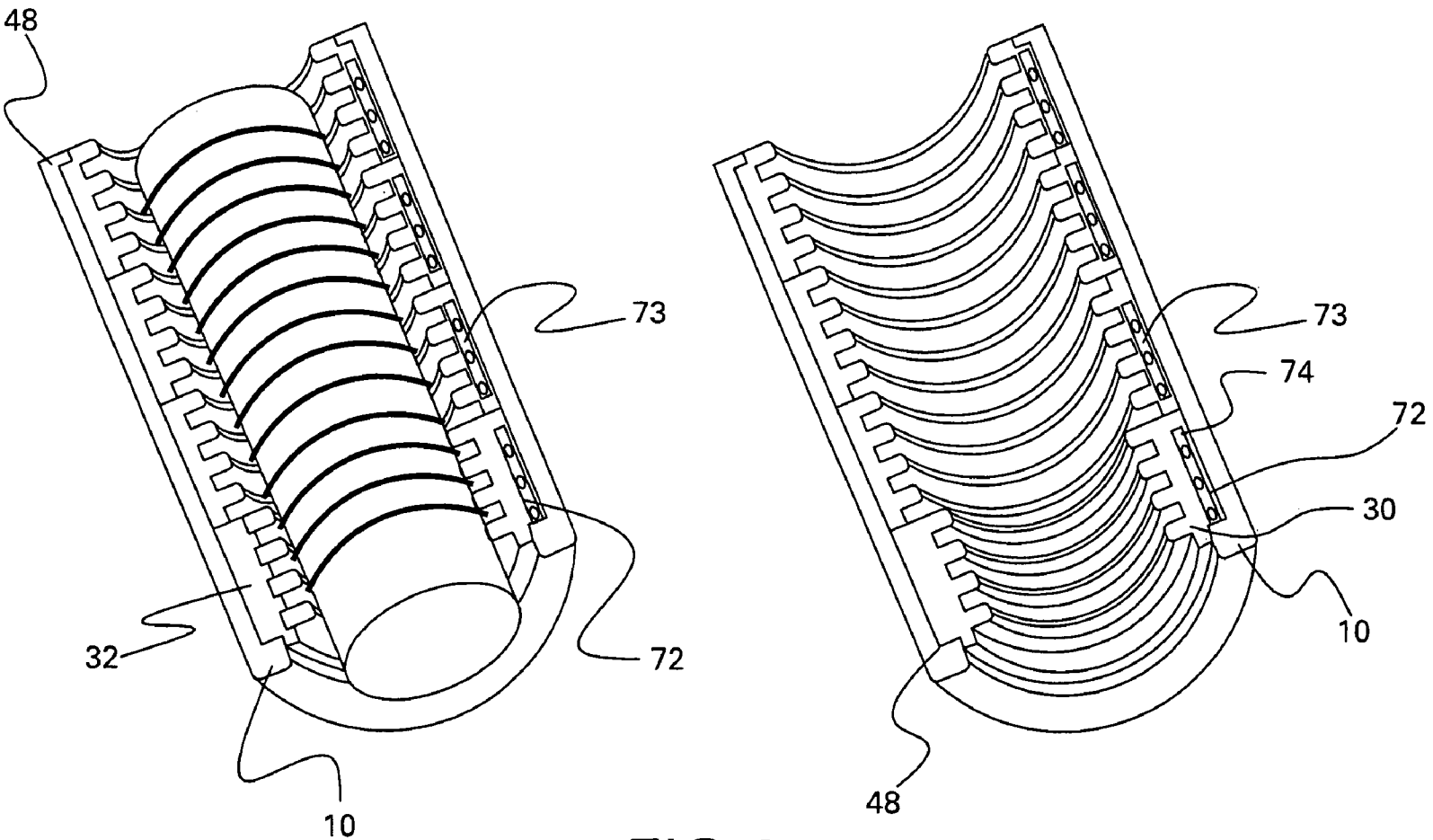
FIG. 8 depicts a perspective view of a best mode of the disclosed apparatus.
Figure 11:
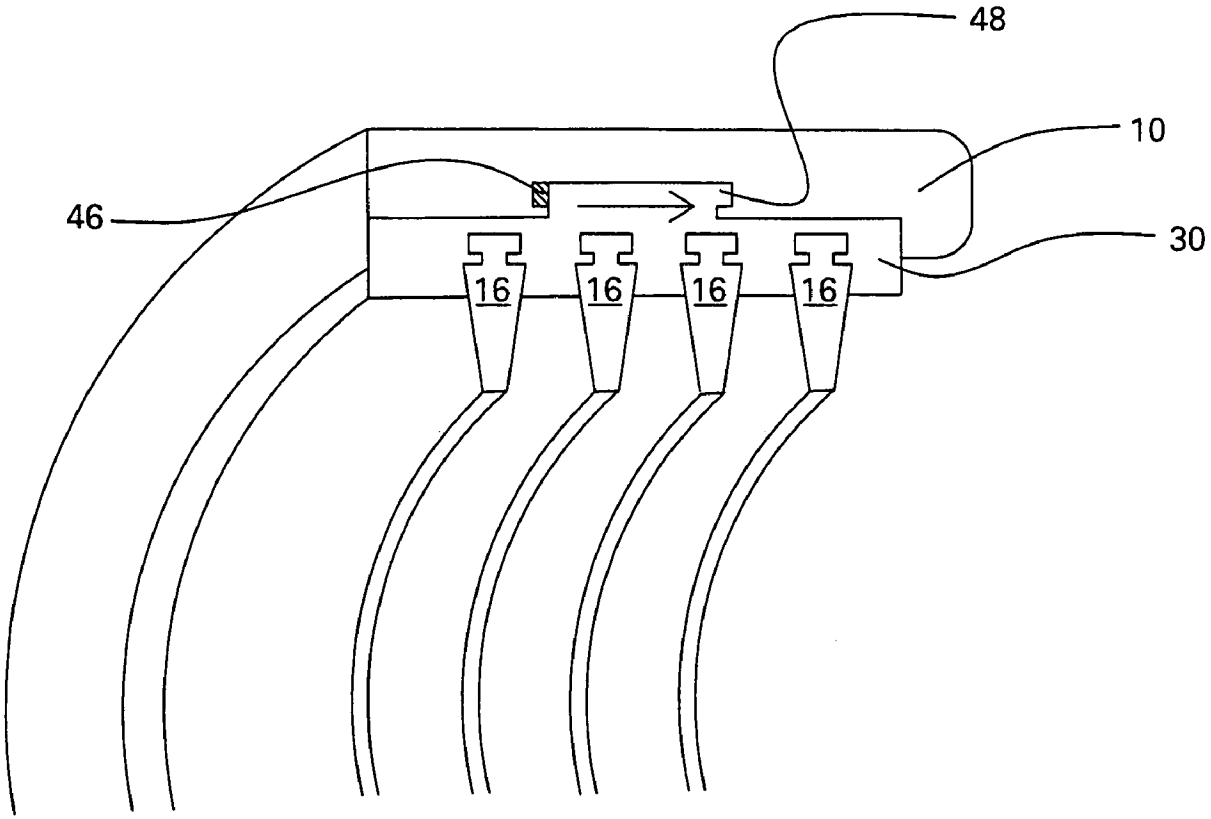
FIG. 11 depicts a cutaway perspective view of shell assembly.

Further, the stator carrier 12 may have a dovetail arrangement 48 with the shell 10 such that when in a resting state, the stator blade tips 22 will not impinge on rotor seals 20. This dovetail 48 is also shown in FIGS. 7, 8 and 11.

Figure 3:
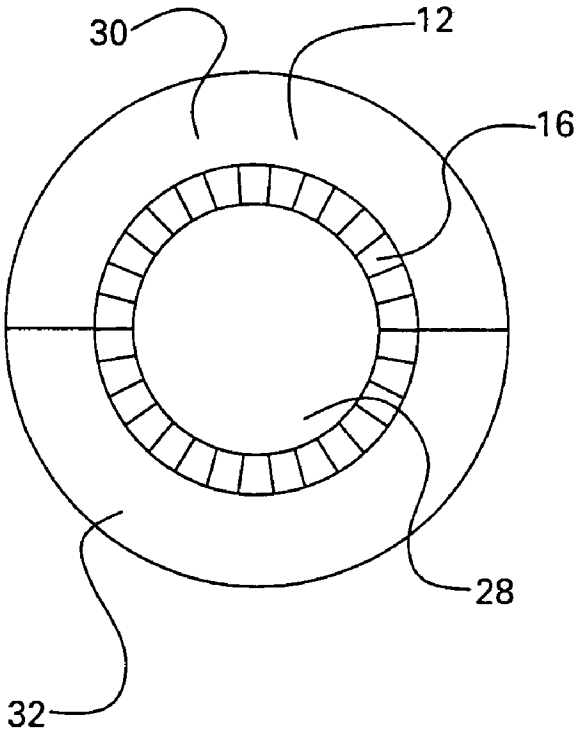
FIG. 3 depicts a front view of a stator carrier.

Referring to FIG. 3, a front view of stator carrier 12 is shown. The rotor 6 and rotating blades 18 are shown removed from the assembly for clarity, but the rotor would be located in the space 28. The stator blades 16 extend centripetally from the stator carrier 12. In an embodiment of the disclosed apparatus, the stator carrier is split along a splitline into a first segment 30 and a second segment 32. The use of ordinal numbers such as "first" and "second" and so on, herein, are meant to be illustrative only, and is not meant to convey any numerical order to components thusly described.

Figure 4:
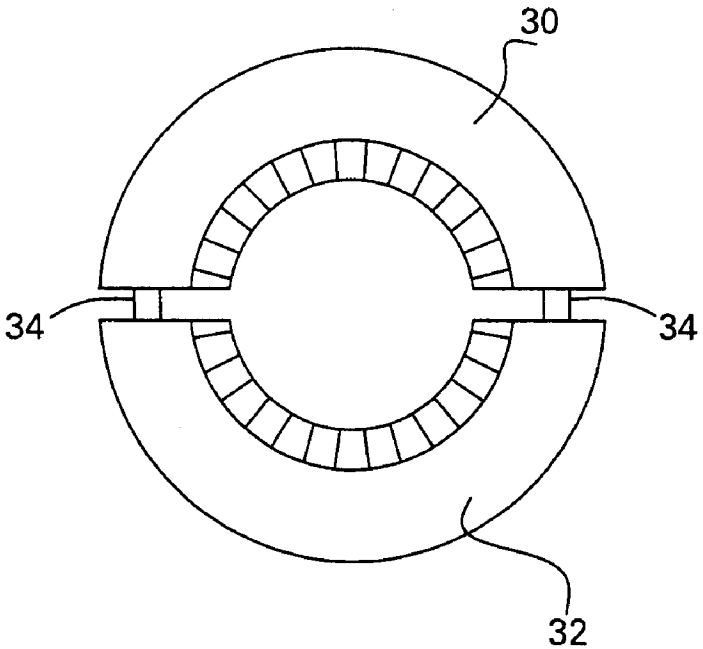
FIG. 4 depicts a front view of a stator carrier.

FIG. 4 shows the first segment 30 and second segment 32 moved radially away from each other by at least two radial displacement apparatuses 34 located at a splitline between the first segment 30 and second segment 32. The shell 10 (not shown in FIG. 4) enclosing first segment 30 and second segment 32 has enough clearance to allow the first and second segments 30,32 to move radially apart as shown in FIGS. 3 and 4.

When the steam turbine is assembled with the rotor and rotating blades in place, the radial movement shown in FIG. 4 will open the clearances between the stator carrier seals 24 and the rotating blade tips 26, and the clearances between the rotor seals 20 and the stator blade tips 22 (seals and blade tips shown in FIG. 2). Thus, immediately prior to a transient condition, one or more displacement apparatuses 34 may be activated to provide greater clearance between the seals 20, 24 and the sealing surfaces, thereby preventing the likelihood of rubs during the transient condition. Since the radial displacement apparatuses only move the first and second segments in one radial direction in this embodiment, the greatest change in the clearances occurs near a line that is collinear with the radial movement of the first and second segments 30, 32. The least amount of change in the clearances occurs orthogonally to that line. Various factors, including but not limited to design and loading conditions, lead to rubs tending to happen near the top and bottom of the steam turbine. Thus if the first and second segments 30,32 move in a vertical direction then sufficient rub protection would be provided for many cases.

Figure 5:
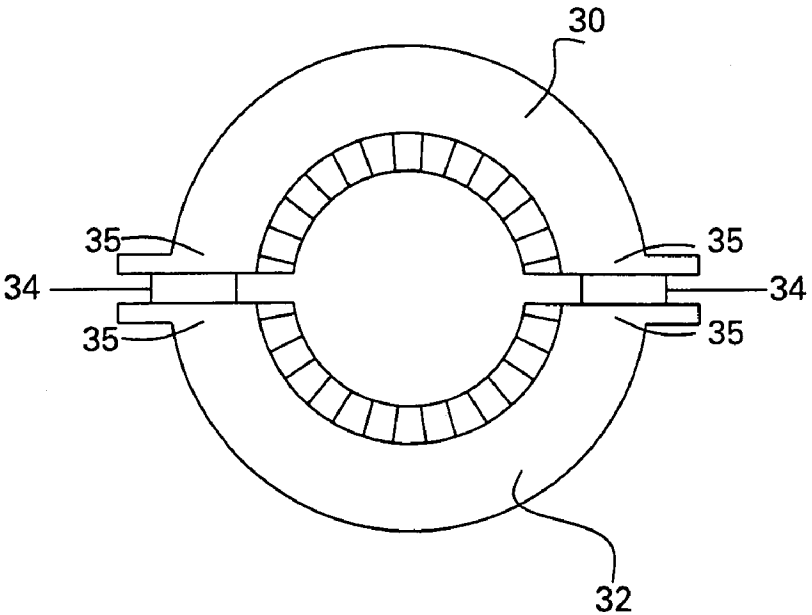
FIG. 5 depicts a front view of a stator carrier with flanges.

FIG. 5 shows another embodiment of the disclosed apparatus. In this embodiment, the upper and second segments 30, 32 have flanges 35. The flanges provide a larger area for the displacement apparatuses 34, thus allowing for larger displacement apparatuses to be used which may provide greater moving force than smaller displacement apparatuses.

Figure 6:
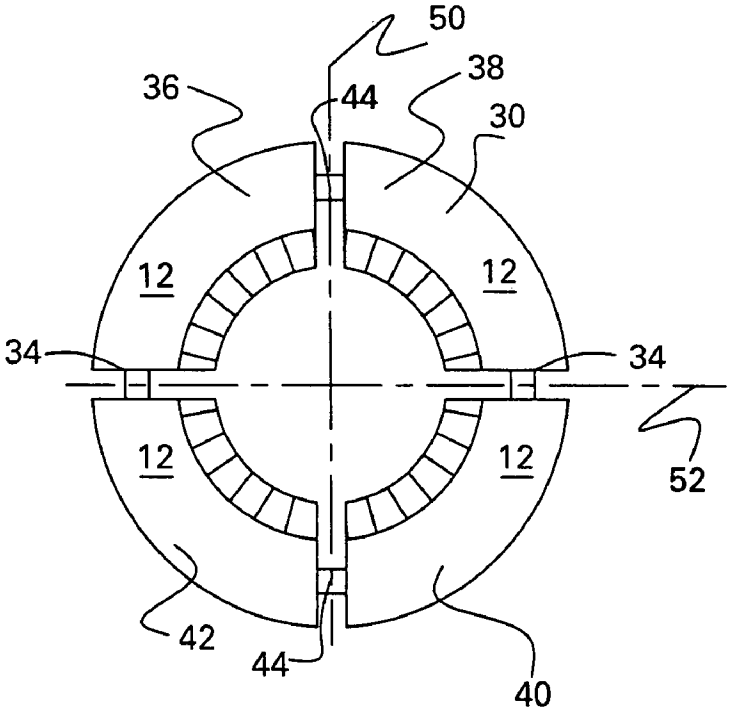
FIG. 6 depicts a front view of a stator carrier that is split about a horizontal and vertical splitline.

FIG. 6 shows another embodiment of the disclosed apparatus. In this embodiment, the stator carrier 12 is split along a vertical splitline 50 and a horizontal splitline 52 forming four stator carrier quad-segments, a first quad-segment 36, a second quad-segment 38, a third quad-segment 40 and a fourth quad-segment 42. The vertical splitline 50 and horizontal splitline 52 shown in FIG. 6 are perpendicular to each other, but in other embodiments, different angular orientation may be used for the split lines depending on the particular clearance needs and geometry of the turbomachine. That is, the split lines 50,52 do not need to lie in a horizontal and vertical plane, and they do not need to be orthogonal to each other. Thus, the quad-segments need not be 90 degree segments, but can vary to satisfy the active clearance control needs of the particular turbomachine. In this embodiment there are two radial displacement apparatuses 34 located at the horizontal splitline between the first segment 36 and fourth segment 42, and between the second segment 38 and third segment 40. In addition, there are two radial displacement apparatuses 34 located at the vertical splitline between the first segment 36 and second segment 38 and between the third segment 40 and fourth segment 42. All four radial displacement apparatuses may activate at the same time thereby providing nearly equal additional clearance between all the seals and sealing surfaces. In another embodiment, fewer than four radial displacement apparatuses may be activated depending on the clearance needs of the turbomachine. Although four displacement apparatuses are shown in the embodiment disclosed in FIG. 6, there may be from one, two and three displacement apparatuses to substantially more located at different axial locations on the stator carrier.

FIG. 7 shows a perspective view of a portion of a shell 10 assembly. In this view, the assembly has been opened at the horizontal splitline with the top half of the shell 10 moved to the right of the bottom half. In this embodiment, four stator carriers 12 are shown installed in the shell 12. In this embodiment each stator carrier has 3 pair of displacement apparatuses 34. However, other embodiments of the disclosed apparatus may have 1, 2, 4 or more pairs of displacement apparatuses per stator carrier. Prior to a transient condition, between one and all of the twenty-four displacement apparatuses would activate, separating the first segments from the second segments, thereby providing an increase in clearances between the seals and the sealing surfaces.

A person skilled in the art will recognize that in embodiments of the disclosed apparatus, that the stator carrier 12 may be simply an inner shell adjustably housed within the shell 10. The stator carrier 12 may be split along a splitline that is coincident with the horizontal splitline of the steam turbine. Further, a radial displacement apparatus 34 may be housed at the splitline of the stator carrier 12 such that the displacement apparatus 34, when non-activated, is completely within either segments 30 or segment 32. For instance, if the displacement apparatus is completely housed within segment 30, then when activated, the displacement apparatus 34 will push against a surface of segment 32, thereby radially pushing apart segments 30 and 32. Those skilled in the art will recognize that the displacement apparatus 34 may be configured to communicate with the segments 30,32 in a variety of ways to radially separate segments 30, 32. The surface of the stator carrier that the displacement apparatus communicates with in order to move the segments 30,32 apart may be machined finished, may have a rough finish, or no finish.

Figure 9:
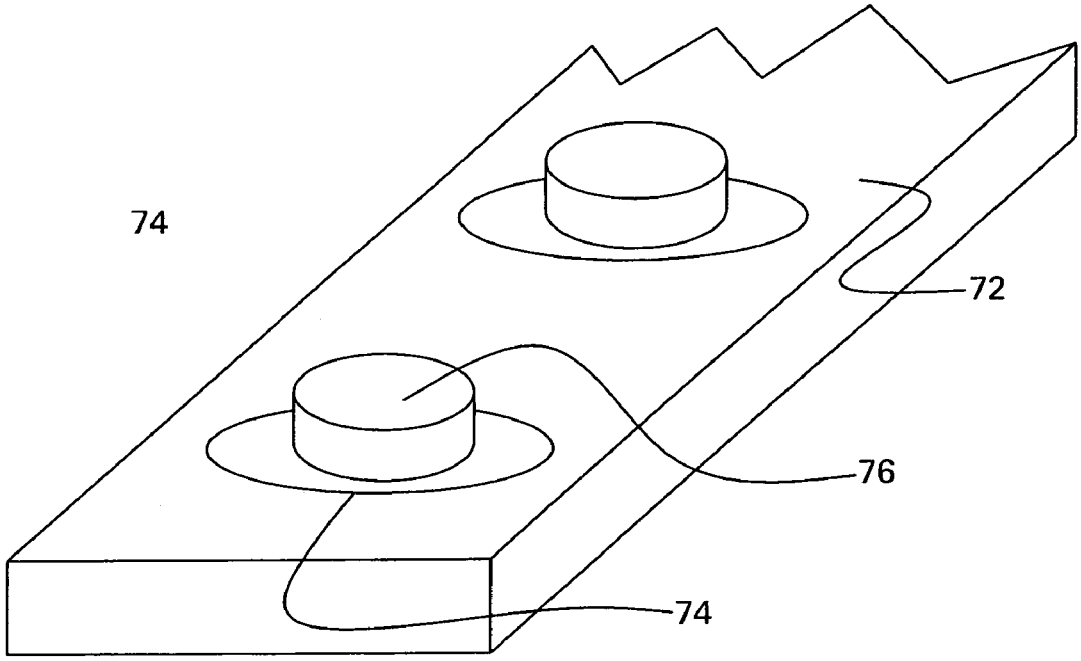
FIG. 9 depicts a partial close up view of an actuator carrier.
Figure 10:
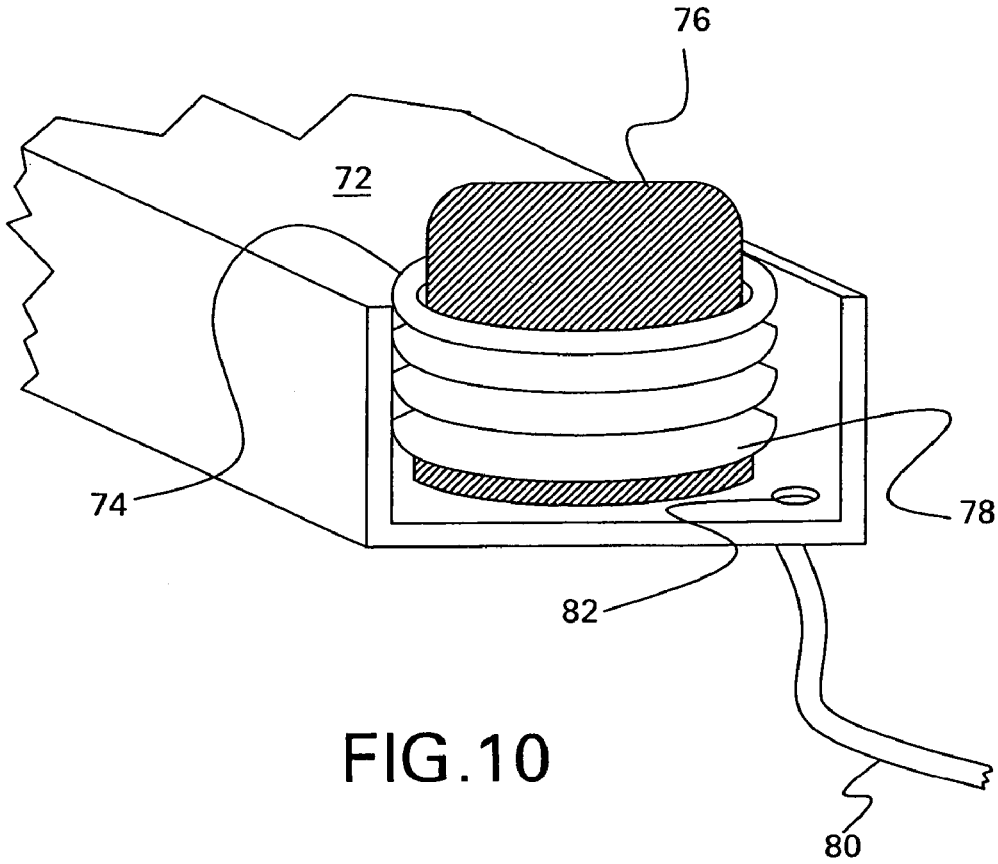
FIG. 10 depicts a cutaway partial view of an actuator carrier.

FIG. 8 is a perspective view of one embodiment of the disclosed apparatus. This embodiment may comprise two actuator carriers 72 housed within a first segment 30 and second segment 32. A trench 73 is machined into the first and second segments 30 and 32 to house the actuator carriers 72. The visible trenches 73 are shown with the actuator carriers 72 removed from it. The actuator carriers 72 may simply sit in the trenches without being fixed to the trenches. However, in other embodiments the actuator carriers 72 may be fixed via welding or fastening (e.g. bolts) in the trenches. Welded into each of the actuator carriers are several pneumatic bellows actuators 74. FIG. 9 shows a partial close up view of the actuator carrier 72 in the first segment 30. The actuator carrier is shown with two pneumatic bellows actuators 74 located thereon. An actuator piston 76 is shown extending from the actuator carrier. When the actuator 74 is not activated, the piston is flush against the actuator carrier 72. The piston 76 is what actually pushes against the opposing second segment 32 in order to provide more clearance to the blade tips. FIG. 10 shows a cutaway partial view of the actuator carrier 72 from FIG. 9. The piston 76 is shown again extending from the actuator carrier 72. However, in this view the bellows 78 of the pneumatic bellows actuator 74 can be seen. A metallic tube 80 is shown in communication with the interior of the actuator carrier 72 via an opening 82. The tube 80 is housed in a channel (not shown) which is drilled into the shell 10 and into the first segment 30. This channel allows the tube 80 to extend from an outer shell of a steam turbine through the shell 10, and through the first segment 30 where it can supply high pressure fluid to the interior of actuator carrier 72. The tube 80 is coupled to the interior surface of an outer shell of the steam turbine. The tube 80 is in communication with a connector on the outer surface of the outer shell of the steam turbine. This connector is in communication with a high pressure fluid supply. Thus to activate the actuators 74, the high pressure fluid supply is turned on, whereupon high pressure fluid travels through the connector into the metallic tube 80 and to the interior of the actuator carrier 72 through the opening 82. Tn this embodiment, the actuator carriers, and the actuators are composed of nickel-base alloy with chromium and iron, such as inconel, which provides for predictable thermal growth characteristics.

Axial Movement

FIG. 11 shows a cutaway perspective view of another embodiment of the disclosed apparatus. A first stator carrier segment 30 is shown adjustably housed within a shell 10. The stator carrier is moveable radially and axially in this embodiment. Axial movement is accomplished by activation of one or more axial displacement apparatuses 46, only one of which is shown in this view. When one or more of the axial displacement apparatuses 46 are activated, the first stator carrier segment 12 and the stator blades 16 move in the direction of the arrow relative to the shell 10. The axial movement of the stator carrier 12 helps lower the force requirements for the radial displacement apparatuses to move the stator carrier segments radially. In this embodiment, the axial displacement apparatuses would axially move the $2^{nd}$ stator carrier segment 32. However there may be occasions where other embodiments are desirable which move either only one or less than all the stator carrier segments axially. Pressure forces acting on the stator blades are very large. These pressure forces act to push the first and second segments 30, 32 together, thereby requiring greater force from the radial displacement apparatuses 34 to push apart the upper and second segments 30, 32. By employing the axial displacement apparatuses described in these embodiments of the disclosed apparatus, the axial position of the stator carrier segments are shifted, thus moving the static seal face location to a location farther upstream, greatly reducing the net pressure force tending to close the seal clearances, making it possible to open seal clearances with significantly less force. This embodiment of the disclosed apparatus may be configured for use in a stator carrier that has been split into four segments (FIG. 6). Also note that the dovetail 48 allows for radial movement of the stator carrier 12, but limits the centripetal movement, thereby stopping the blades 16 from impinging the rotor due to clearance between the stator carrier segments 30,32 and the shell 10.

A similar embodiment to that disclosed with respect to FIGS. 8–10 may be applied to the axial displacement apparatuses wherein pneumatic bellows actuators and actuator carriers may be used with a metallic tube to supply high pressure fluid to the actuators.

Control System

Other embodiments of the disclosed apparatus may use radial position sensors to monitor the radial position of the stator seals relative to the rotor. By monitoring the position of the stator seals, it can be determined whether the system is in a rub state, or about to enter a rub state, and whether active clearance control should be implemented. Feedback from the radial position sensors can be used to verify that the active clearance control is providing enough clearance to the blade tips to prevent rubs from occurring. In addition, signals from the radial position sensors may be used to provide discrete changes to the blade tip clearances. The radial position sensors may be eddy-current probes, photoelectric sensors, and magnetic sensors, but are not limited to them.

In other embodiments of the disclosed apparatus, a control system may be implemented for a turbomachine. The control system would control the radial movement of the stator carrier segments utilizing signals from radial position sensors.

Method

Figure 12:
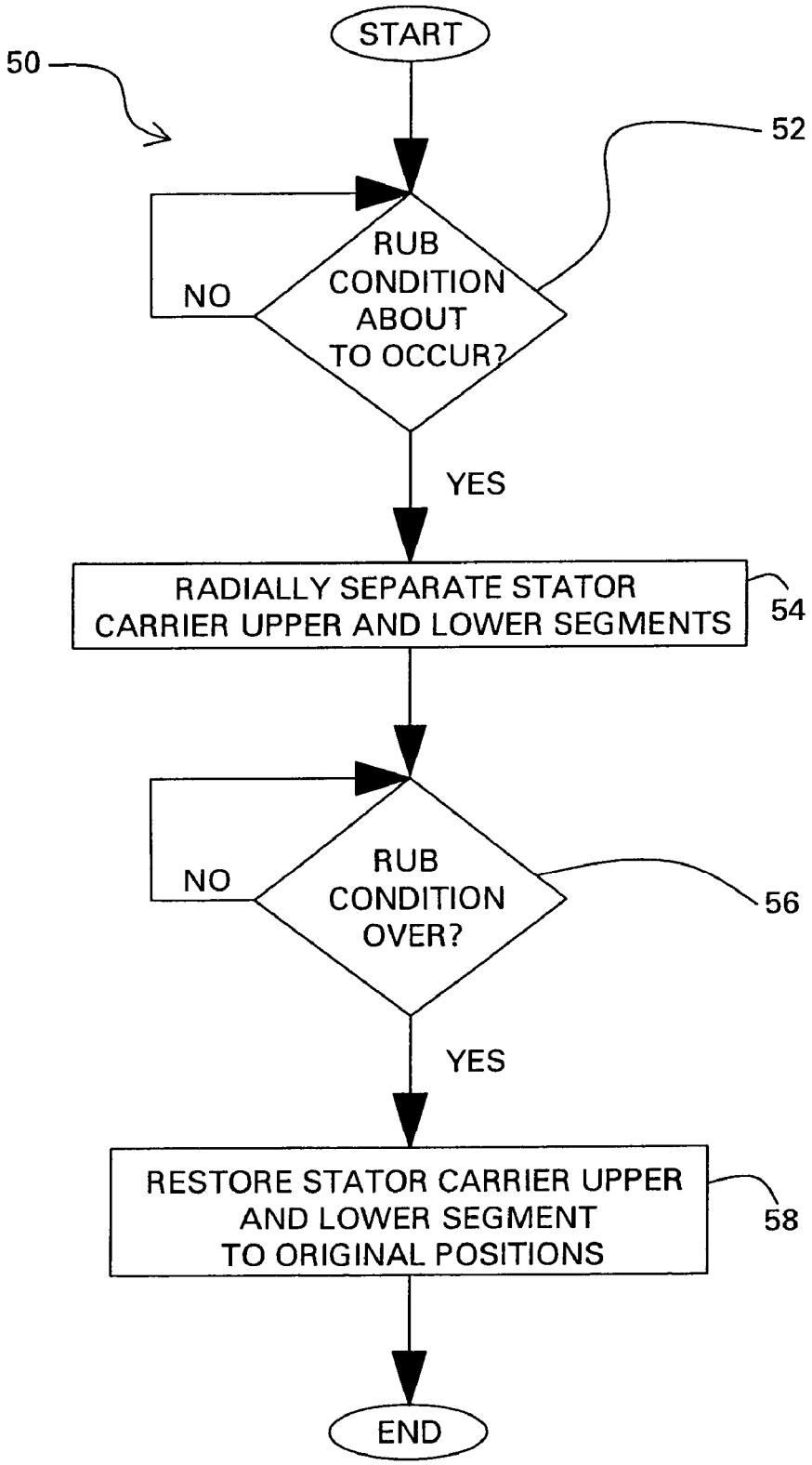
FIG. 12 depicts a flow chart illustrating an embodiment of a disclosed method.

Referring to the flowchart of FIG. 12, a method 50 for providing active clearance control to a turbomachine is shown. At decision block 52 it is determined whether a rub condition is about to occur. If a rub condition is about to occur, then at process block 54, the first segment is separated radially from the second segment. At decision block 56, it is determined whether the rub condition is over. If the rub condition is over, then at process block 58, the first segment and the second segment are restored to their original positions.

Figure 13:
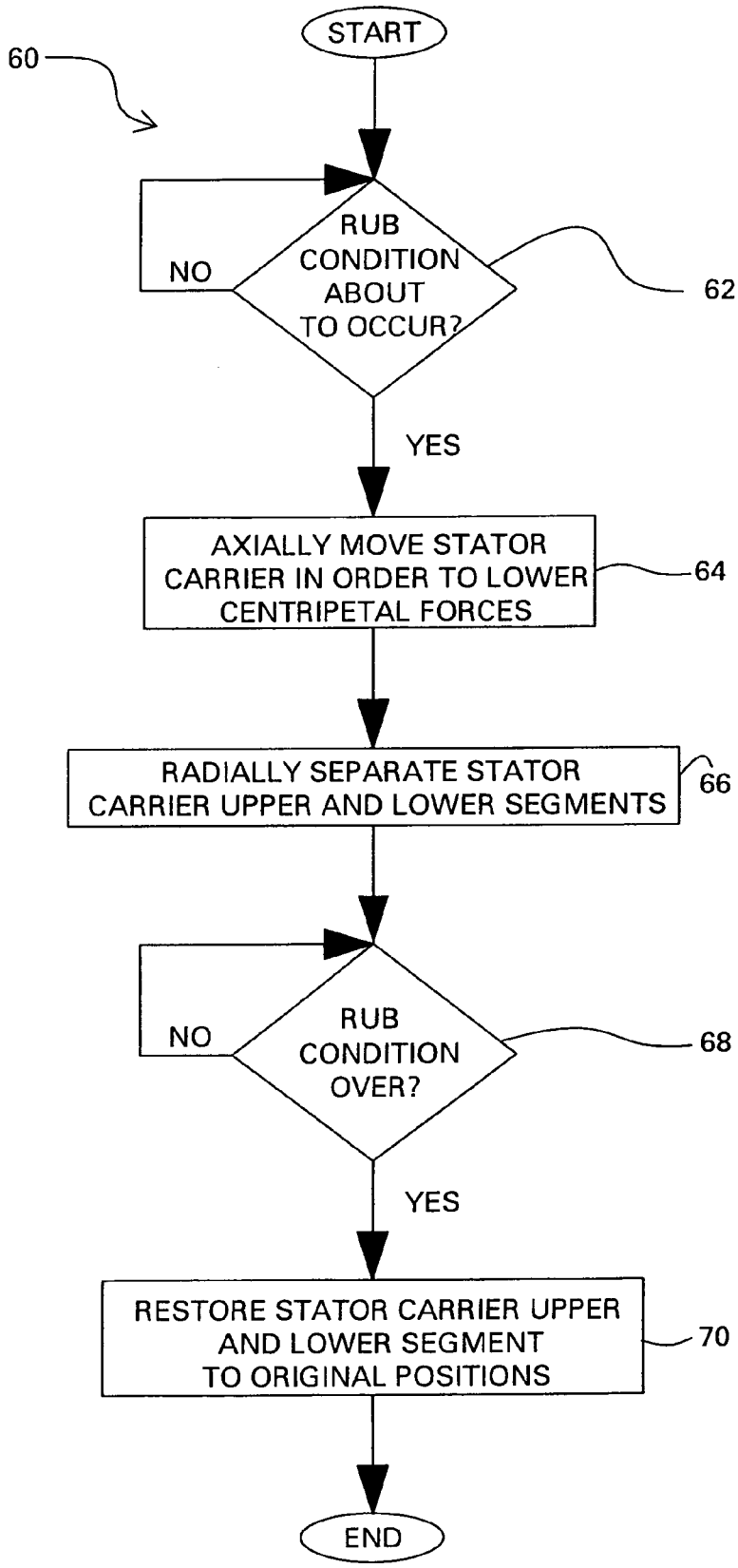
FIG. 13 depicts a flow chart illustrating another embodiment of a disclosed method.

Referring to FIG. 13, another method 60 for providing active clearance control to a turbomachine is shown. At decision block 62 it is determined whether a rub condition is about to occur. If a rub condition is about to occur, then at process block 64, the stator carrier is axially moved in order to lower the centripetal forces acting on the stator carrier. At process block 66, the first segment is radially separated from the second segment. At decision block 68, it is determined whether the rub condition is over. If the rub condition is over, then at process block 70, the first segment and the second segment are restored to their original positions.

The disclosed embodiments have the advantage of providing active clearance control to the rotating and stator blade tips, thus lowering the risk of rubs damaging the turbomachine. An advantage of the disclosed embodiments relating to the stator carriers split along two split lines is that they may allow for a more even distribution of radial clearance to the blade tips. Another advantage is that the embodiments may allow for selective clearance control near one or the other split lines. The disclosed embodiments relating to axial movement have the advantage of lowering the pressure forces acting centripetally on the stator carrier segments, thus allowing smaller and less expensive displacement apparatuses to be used to radially move apart the stator carrier segments.

While the embodiments of the disclosed method and apparatus have been described with reference to exemplary embodiments, it will be understood by those skilled in the art that various changes may be made and equivalents may be substituted for elements thereof without departing from the scope of the embodiments of the disclosed method and apparatus. In addition, many modifications may be made to adapt a particular situation or material to the teachings of the embodiments of the disclosed method and apparatus without departing from the essential scope thereof. Therefore, it is intended that the embodiments of the disclosed method and apparatus not be limited to the particular embodiments disclosed as the best mode contemplated for carrying out the embodiments of the disclosed method and apparatus, but that the embodiments of the disclosed method and apparatus will include all embodiments falling within the scope of the appended claims.

The invention claimed is:

1. A turbomachine with active clearance control comprising:

a centrally disposed rotor;

at least one row of rotating blades extending radially from the rotor, and each of the rotating blades having a rotor blade tip;

a shell enclosing the rotor and rotating blades;

at least one stator carrier split along a splitline into a first segment and a second segment, with at least one row of stator blades extending centripetally from the first segment and from the second segment, the at least one stator carrier adjustably housed within the shell and each of the stator blades having a stator blade tip, and with stator seals centripetally disposed on the first segment and second segment; and at least one displacement apparatus, each individual displacement apparatus in operable communication with the first segment and the second segment, and the at least one displacement apparatus is configured to move the first segment and second segment radially away from each other thereby providing active clearance control to the rotor blade tips and the stator blade tips.

2. The turbomachine of claim 1, further comprising:

a plurality of axial actuators operatively coupled to the stator carrier and to the shell; and wherein the plurality of axial actuators are configured to move the stator carrier axially with respect to the shell.

3. The turbomachine of claim 1, wherein:

the first segment is split along a first splitline, and forms a first quad-segment and a second quad-segment;

the second segment is split along a second splitline, and forms a third quad-segment and a fourth quad-segment; and the turbomachine further comprises:

at least one displacement apparatus which is in operable communication to the first quad-segment and to second quad-segment, and is configured to move the first quad-segment and the second quad-segment radially away from each other; and at least one displacement apparatus which is in operable communication to third quad-segment and to the fourth quad-segment, and is configured to move the third quad-segment and the fourth quad-segment radially away from each other.

* * * * *